US010668481B2

(12) United States Patent
Rem et al.

(10) Patent No.: US 10,668,481 B2
(45) Date of Patent: Jun. 2, 2020

(54) SPLITTER FOR MAGNETIC DENSITY SEPARATION

(71) Applicant: Feelgood Metals B.V., Rotterdam (NL)

(72) Inventors: Peter Carlo Rem, Delft (NL); Simon Petrus Maria Berkhout, Delft (NL)

(73) Assignee: FEELGOOD METALS B.V., Rotterdam (NL)

( * ) Notice: Subject to any disclaimer, the term of this patent is extended or adjusted under 35 U.S.C. 154(b) by 26 days.

(21) Appl. No.: 16/064,344

(22) PCT Filed: Dec. 20, 2016

(86) PCT No.: PCT/NL2016/050897
§ 371 (c)(1),
(2) Date: Jun. 20, 2018

(87) PCT Pub. No.: WO2017/111583
PCT Pub. Date: Jun. 29, 2017

(65) Prior Publication Data

US 2019/0001341 A1 Jan. 3, 2019

(30) Foreign Application Priority Data

Dec. 21, 2015 (NL) ..... 2015997

(51) Int. Cl.
*B03B 5/36* (2006.01)
*B03C 1/32* (2006.01)
*B03B 5/44* (2006.01)

(52) U.S. Cl.
CPC ..... *B03B 5/36* (2013.01); *B03B 5/442* (2013.01); *B03C 1/32* (2013.01)

(58) Field of Classification Search
CPC .... B07C 1/30; B07C 1/32; B03B 5/36; B03B 5/442

(Continued)

(56) References Cited

U.S. PATENT DOCUMENTS 4,062,765 A * 12/1977 Fay ..... B03B 5/30 209/1
4,113,608 A * 9/1978 Kazama ..... B03C 1/32 209/1

(Continued)

FOREIGN PATENT DOCUMENTS

EP 2 247 386 6/2012
FR 2 548 552 1/1992

(Continued)

OTHER PUBLICATIONS

International Search Report from PCT/NL2016/050897 dated Mar. 15, 2017.

(Continued)

*Primary Examiner* — Terrell H Matthews
(74) *Attorney, Agent, or Firm* — Adsero IP

(57) ABSTRACT

A system and method for magnetic density separation of products. The system including a magnet configured to amplify a density gradient in a magnetic liquid for separating the products in the magnetic liquid according to their different density. A plate shape is disposed along a product path where respective products travel through the magnetic liquid. A driving mechanism is configured to drive the plate shape with a reciprocating motion for lowering a static friction of the respective products coming into contact with the plate shape. Accordingly, process continuity can be improved while maintaining a high separation efficiency, in particular by alleviating material build-up and clogging of products at the splitter and other surfaces with minimal disturbance to the process flow.

20 Claims, 4 Drawing Sheets

(58) Field of Classification Search
USPC ..... 209/3, 39, 132, 175, 232
See application file for complete search history.

(56) References Cited

U.S. PATENT DOCUMENTS

| | | | | |
|---|---|---|---|---|
| 8,381,913 | B2 * | 2/2013 | Rem | B03C 1/0335 209/155 |
| 8,485,363 | B2 * | 7/2013 | Nagelvoort | B03C 1/01 209/1 |
| 9,833,793 | B2 * | 12/2017 | Polinder | B03C 1/01 |
| 2002/0153295 | A1 | 10/2002 | Kimura | |

FOREIGN PATENT DOCUMENTS

| | | | | |
|---|---|---|---|---|
| SU | 1 719 086 | | 3/1992 | |
| SU | 1719086 | A1 * | 3/1992 | B03C 1/32 |
| WO | WO 2015/050451 | | 4/2015 | |
| WO | WO-2015050451 | A1 * | 4/2015 | B03C 1/32 |

OTHER PUBLICATIONS

Van Wayenburg (2005) "Variable-Density Fluid Accurately Separates Plastics in a Single Process"; Website [Online] Available Website: http://www.tudelft.nl/fileadmin/UD/MenC/Support/Internat/TU_Website/TU_Delft_portal/Actueel/Magazines/Delft_Interraal/archief/2005_D1/2005-3/doc/D005-3-1.

Xiong et al. (1998) Int. J. Miner. Process. 54:111-127 "New Technology of Pulsating High Gradient Magnetic Separation".

* cited by examiner

SPLITTER FOR MAGNETIC DENSITY SEPARATION

RELATED APPLICATIONS

This application is a 35 U.S.C. § 371 national phase application of PCT/NL2016/050897 (WO 2017/111583), filed on Dec. 20, 2016, entitled "Splitter for Magnetic Density Separation", which application claims priority to Netherlands Application No. 2015997, filed Dec. 21, 2015, which is incorporated herein by reference in its entirety.

TECHNICAL FIELD AND BACKGROUND

The present disclosure relates to a system and method for magnetic density separation (MDS).

Density separation is used in raw materials processing for the classification of mixed streams into streams with products (e.g. particles) of different types of materials. In an accurate form of density separation, a liquid medium is used in which the lighter material float and the heavier materials sink. The process requires a liquid medium that has a density that is intermediate between the density of the light and heavy materials in the feed, yet is inexpensive and safe. In magnetic density separation this is provided using a magnetic liquid. The magnetic liquid has a material density which is comparable to that of water. However, when a gradient magnetic field is applied to the magnetic liquid, the force on a volume of the liquid is the sum of gravity and the magnetic force. In this way, it is possible to make the liquid artificially light or heavy, resulting in an amplified density gradient.

For example, EP 2 247 386 B1 describes a method and apparatus for separating solid particles of different densities, using a magnetic process fluid. The solid particles are mixed in a small partial flow of the process fluid. The small turbulent partial flow is added to a large laminar partial flow of the process fluid, after which the obtained mixture of the respective partial process fluids is conducted over, under, or through the middle of a magnet configuration. Particles are separated into lighter particles at the top of the laminar process fluid and heavier particles at the bottom of the laminar process fluid, each of which are subsequently removed with the aid of a splitter. The materials of low density and the materials of high density are separated from the respective process streams, dried and stored and finally, the process streams are returned to the original starting process fluid streams.

The present disclosure aims to improve process continuity while maintaining a high separation efficiency, in particular by alleviating material build-up and clogging of products at the splitter and other surfaces with minimal disturbance to the process flow.

SUMMARY

Thereto a first aspect of the present disclosure provides a system for magnetic density separation of products, e.g. solid particles having different densities. The system comprises a magnet configured to amplify a density gradient in a magnetic liquid (e.g. ferrofluid) for separating the products in the magnetic liquid according to their different density. A plate shape such as the splitter or other surface is disposed along a product path where respective products travel through the magnetic liquid. The system comprise a driving mechanism configured to drive the plate shape with a reciprocating motion.

By the reciprocating motion of the plate shape, a static friction of respective products coming into contact with the plate shape can be lowered or even completely cancelled. Accordingly, products may move more freely along their intended path over the plate shape by the resultant forces of drag, gravitation, and/or magnetism with less chance of getting stuck. It will be appreciated that the effect of the reciprocating motion can be particularly strong as the plate with particles moves through a relatively heavy magnetic liquid. Advantageously, the reciprocating motion may cause only minimal displacement of the magnetic liquid because the plate can move back and forth. Furthermore, the reciprocating plate may be more cost efficient and reliable than other transport mechanisms particularly when immersed in a high density magnetic liquid.

By keeping the amplitude of the reciprocating motion relatively low, the amount of liquid displacement can be minimized. A frequency of the reciprocating motion may be adjusted to provide an optimal effect with regards to the prevention of static friction while minimally affecting the liquid. For example, the amplitude and frequency of vibration may typically be one millimetre (two millimetre between extremes) at a rate between ten and twenty Hertz. Displacement of the liquid can be further minimized when the plate moves along a direction of its surface. Ideally the plate moves along an in-plane direction.

By aligning the direction of the plate with a direction of the process flow, the products may flow along the plate without cutting into a separated stream of products. For example, a line on a surface of the plate may be aligned to coincide with an equidensity line with constant density gradient in the magnetic liquid along which path specific products (matching that density) may flow. Depending on the magnet configuration, equidensity lines may lie in horizontal or tilted above, below or between one or more magnets. Accordingly, the flat plate shape may extend along a plane to accommodate the product path. Advantageously, when the reciprocating plate is tilted, the particles may move down along the plate under the influence of gravity even in the absence of flow. This is particularly useful when the tilted reciprocating plate is used as a splitter at the end of a process channel where products may otherwise get stuck when they leave the influence area of the magnet.

By reciprocating the plate in a direction mostly or entirely parallel to the product path, the particles may be less disturbed in their trajectory e.g. compared to a plate reciprocating with a component transverse to the product path. By using the reciprocating plate as an alternative to a standard splitter plate, clogging at the exit of the process stream can be alleviated. For example, the plate may form one or more walls of an exit channel and/or receiver bin. The reciprocating plate may also find other places of application, e.g. instead of or in addition to a conveyor belt. For example, the reciprocating plate shape may alternatively, or additionally, be provided between the magnet and the product stream.

The reciprocating plate shape can provide advantages to various systems for magnetic density separation. For example, the plate shape can be used in combination with a laminar flow of magnetic liquid. In such a system, the plate shape provides the advantage that the laminar flow remains relatively undisturbed. The plate shape can also be used in a container with a non-flowing liquid, e.g. wherein the particles are transported through the magnetic liquid by means of gravity, falling along sloped magnetic density lines. When the plate shape itself is also tilted, gravity may move the particles along the plate while minimizing static friction.

The reciprocating plate shape can be used in combination with various magnet configurations. For example a flat magnet can be used to provide a density gradient in horizontal or tilted planes above (or below) the magnet. Alternatively, a pair of flat magnets may provide a density gradient there between. In such configurations, the plate shape is advantageously disposed in a direction transverse to the density gradient, which is typically the direction of the (equilibrated) process flow. Multiple magnets and/or magnetisable pole pieces can be used to provide a desired magnetic field. For example, a Halbach array can be used to enhance the magnetic field on one side of a flat magnet. Preferably a permanent magnetic material is used, e.g. comprising rare earth metals. Alternatively, electromagnetic configurations may provide similar functionality.

By providing a container holding the magnetic liquid a relatively large operating volume may be provided. This may allow more than two separate process streams. For example six to eight different streams of products can be separated at once. The various exit channels or bins may be formed between a plurality of reciprocating plates. The plates may be actuated by a common or separate driving mechanism, e.g. actuator. The plates may follow a linear path, e.g. by sliding or rolling along a linear guidance structure. In addition to the one or more reciprocating plates, also one or more other transport systems may be present. For example, a conveyor belt may be provided between the magnet and the process flow to remove any product that would otherwise get stuck on the magnet, e.g. very heavy and/or magnetisable materials in the process stream can be forcefully moved by riffles on the conveyor belt. By incorporating a magnetisable material in the conveyor belt, this material may be attracted to the magnet which may be advantageous to at least partially compensate a buoyancy of the conveyor belt. For example steel wires may be incorporated in the conveyor belt. By using cylindrical wires transverse to a direction of movement of the conveyor belt, the magnetic force may be independent of the orientation of the field with respect to the wire which is particularly advantageous in an endless conveyor belt traveling around the magnet configuration.

By providing a wedge shaped plate, the reciprocating motion may not only be advantageous to move the products along it surface but also to push products that would otherwise get stuck at the edge of the plate facing the incoming product stream. For example a V-shaped plate may be used to push the stuck product outward to a side of the channel where the products can be separately collected, e.g. by a collection chamber below the side of the plate.

Further aspects of the present disclosure may be embodied in methods of magnetic density separation comprising providing a magnet to amplify a density gradient in a magnetic liquid for separating the products in the magnetic liquid according to their different density; providing a plate shape disposed along a product path where respective products travel through the magnetic liquid; and driving the plate shape with a reciprocating motion for lowering a static friction of the respective products coming into contact with the plate shape.

BRIEF DESCRIPTION OF DRAWINGS

These and other features, aspects, and advantages of the apparatus, systems and methods of the present disclosure will become better understood from the following description, appended claims, and accompanying drawing wherein:

DESCRIPTION OF EMBODIMENTS

Figure 1A:
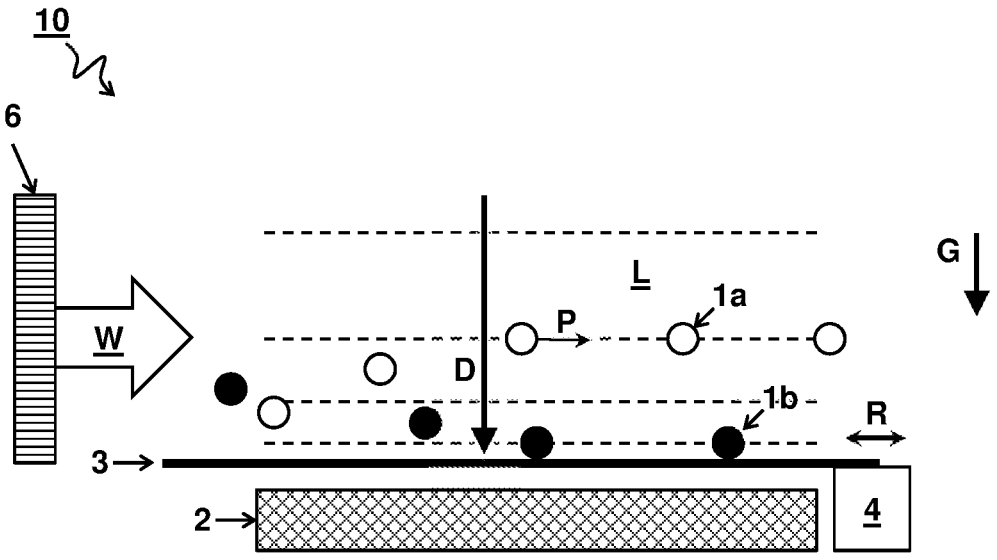
FIG. 1A schematically illustrates a cross-section side view of an embodiment with a flow generator and a reciprocating plate as a platform below the product stream.

Unless otherwise defined, all terms (including technical and scientific terms) used herein have the same meaning as commonly understood by one of ordinary skill in the art to which this invention belongs as read in the context of the description and drawings. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some instances, detailed descriptions of well-known devices and methods may be omitted so as not to obscure the description of the present systems and methods. Terminology used for describing particular embodiments is not intended to be limiting of the invention. As used herein, the singular forms "a", "an" and "the" are intended to include the plural forms as well, unless the context clearly indicates otherwise. The term "and/or" includes any and all combinations of one or more of the associated listed items. It will be understood that the terms "comprises" and/or "comprising" specify the presence of stated features but do not preclude the presence or addition of one or more other features.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. The description of the exemplary embodiments is intended to be read in connection with the accompanying drawings, which are to be considered part of the entire written description. In the drawings, the absolute and relative sizes of systems, components, layers, and regions may be exaggerated for clarity. Embodiments may be described with reference to schematic and/or cross-section illustrations of possibly idealized embodiments and intermediate structures of the invention. In the description and drawings, like numbers refer to like elements throughout. Relative terms as well as derivatives thereof should be construed to refer to the orientation as then described or as shown in the drawing under discussion. These relative terms are for convenience of description and do not require that the system be constructed or operated in a particular orientation unless stated otherwise.

FIG. 1A schematically illustrates a cross-section side view of an embodiment of a system 10 for magnetic density separation of products 1*a*,1*b*, e.g. solid particle. The products having different densities are indicated herein with circles having different shading. For example, the darker shading may correspond to a heavier product. For example, the products may be unprocessed e.g. plastic bottles, party processed e.g. scraps from cutting up bottles, or fully processed e.g. smaller particles of material to be separated. The products may comprise plastic, metal, or any other solid material that can be separated on the basis of its density.

The system 10 comprises a magnet 2 configured to amplify a density gradient D in a magnetic liquid L. The direction of the arrow indicates a direction of increasing density. The dashed lines schematically illustrate different equidensity planes or lines above the magnet 2.

The system 10 comprises a plate shape 3 disposed along a product path P where respective products 1*b* travel through the magnetic liquid L. The plate shape is formed by a flat generally two-dimensional structure. To displace minimal liquid, the plate is preferably thin. For example the plate may have a thickness between one and five millimetres, or less. The surface of the plate may be relatively large to form a barrier between process streams and/or path along which the products may travel.

The system 10 comprises a driving mechanism 4 configured to drive the plate shape 3 with a reciprocating motion R. This may lower a static friction of the respective products 1*b* coming into contact with the plate shape 3. For example the driving mechanism 4 comprises a reciprocating drive shaft that is connected to a side of the plate shape 3. Alternatively, a rotating motion of the driving mechanism 4 may be converted into a linear reciprocating motion e.g. by a linear guidance.

In the shown embodiment, the products flow from left to right as they reach an equilibrium height according to their density. In one embodiment, the system 10 comprises a flow generator 6 configured to generate a flow W in the magnetic liquid L. For example, the flow generator 6 comprises a laminator configured to generate a laminar flow F of the magnetic liquid L over the magnet 2. Typically, the product path P is transverse to the density gradient D. The density gradient D may typically result from the sum of gravity and magnetic forces.

In one embodiment, the magnet 2 is a flat magnet. For example, a plane of the (flat) magnet 2 extends along length of the product path P. In the shown embodiment, the magnet 2 is disposed below the product path P, which may be preferable because this allows the density amplification of the magnet to be in the same direction as the effects of gravity G. Alternatively, or in addition, a magnet may be disposed elsewhere, e.g. above the product path P.

Figure 1B:
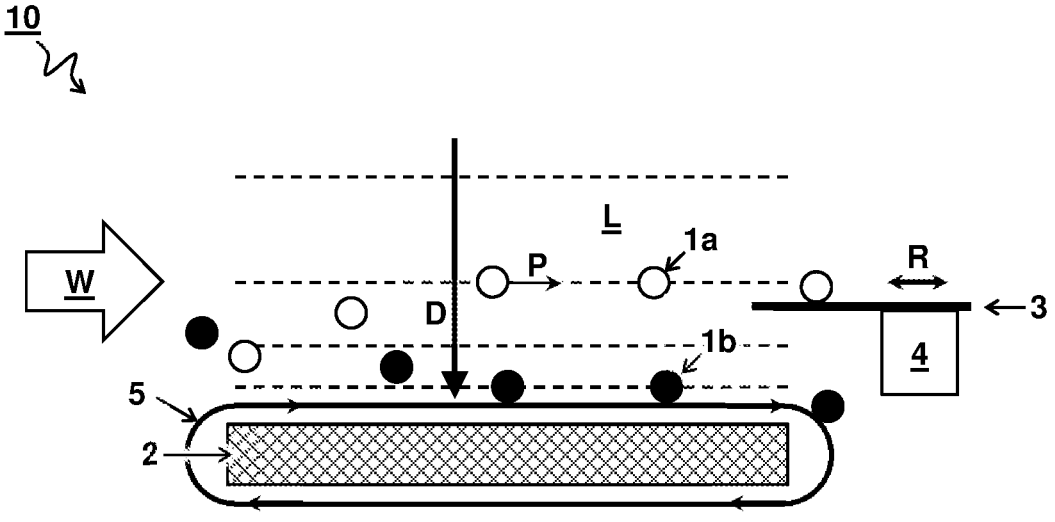
FIG. 1B schematically illustrates a cross-section side view of an embodiment with a reciprocating plate as a divider at an end of the product stream.

In the embodiment of FIG. 1A, the plate shape 3 is disposed to at least partially cover the magnet 2 to prevent the products 1*a*,1*b* coming into contact with the magnet 2. FIG. 1B schematically illustrates a cross-section side view of another embodiment wherein the plate shape 3 is arranged as a splitter plate in the magnetic liquid L between a first product stream 1*a* that is separated in the magnetic liquid L from a second product stream 1*b*.

In the embodiments, the reciprocating motion R is directed along an in plane direction of the plate shape 3 for displacing a minimum of magnetic liquid L while moving. In one embodiment, the driving mechanism 4 is configured to drive the plate shape 3 with a reciprocating motion R having an amplitude of at least half a millimetre (one millimetre between extremes) and/or the reciprocating motion R has a amplitude of at most five millimetres (ten millimetres between extremes), e.g. an amplitude between one and three millimetres. Preferably, the driving mechanism 4 is configured to drive the plate shape 3 with reciprocating motion R having a frequency between one and fifty Hertz, preferably between five and thirty Hertz, more preferably between ten and twenty Hertz.

According to further aspects, the figures illustrate a method of magnetic density separation of products 1*a*,1*b*. In one embodiment, the method comprising providing a magnet 2 to amplify a density gradient D in a magnetic liquid L for separating the products 1*a*,1*b* in the magnetic liquid L according to their different density Da, Db. In another or further embodiment, the method comprises providing a plate shape 3 disposed along a product path P where respective products 1*b*' travel through the magnetic liquid L. In another or further embodiment, the method comprises driving the plate shape 3 with a reciprocating motion R for lowering a static friction of the respective products 1*b*" coming into contact with the plate shape 3.

Figure 2A:
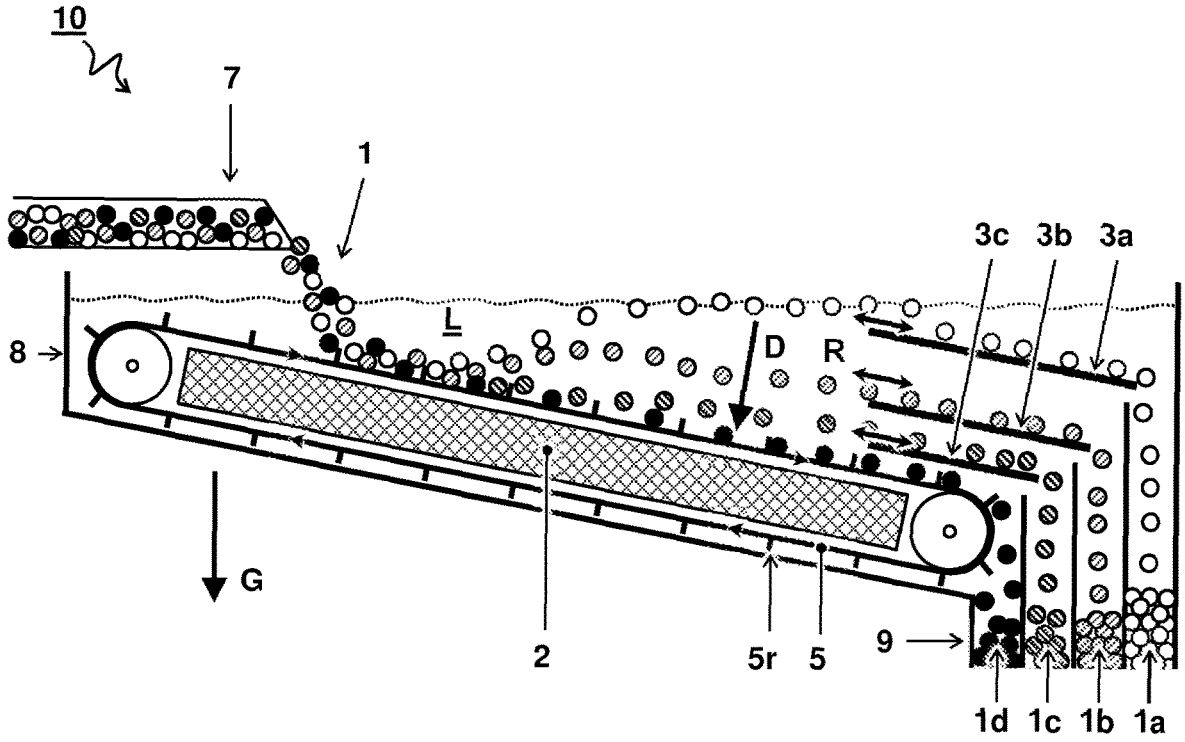
FIG. 2A schematically illustrates a cross-section side view of an embodiment with a tilted magnet and multiple reciprocating plates as dividers.

FIG. 2A schematically illustrates a cross-section side view of an embodiment with a tilted magnet 2 and multiple reciprocating plates 3*a*-3*c* arranged as a dividers in the process stream.

In one embodiment, the system 10 comprises two or more reciprocating plate shapes 3*a*,3*b*,3*c* that form respective splitter plates between the separated products. In another or further embodiment, the system 10 comprises two or more exit channels 9 to receive the separated products 1*a*-1*d*. Alternatively or in addition, the system may comprise two or more receiver bins (not shown) to receive the separated products 1*a*-1*d*.

In one embodiment, the system 10 comprises a container 8 for holding the magnetic liquid L. In another or further embodiment, the plate shape 3 is (in use) at least partially in contact with the magnetic liquid. For example, the plate shape 3 is immersed in and/or covered by the magnetic liquid. In another or further embodiment, the plate shape is at least partially disposed in the container.

In one embodiment, the system 10 comprises a conveyor belt 5 configured to transport products as they comes into contact with the conveyor belt 5. For example the conveyor belt may be an endless belt which may cover the magnet. The conveyor belt 5 may comprise riffles 5*r* or other structures to push the products along a direction of the conveyor belt.

Preferably, the one or more inclined splitter plates 3*a*-3*c* are not connected to vertical walls separating the product compartments 9 so they can independently reciprocate along respective in plane directions while the vertical walls remain stationary. For example, the splitter plates can be attached to a driving mechanism at a side of the plate (shown e.g. in FIG. 4B).

Figure 2B:
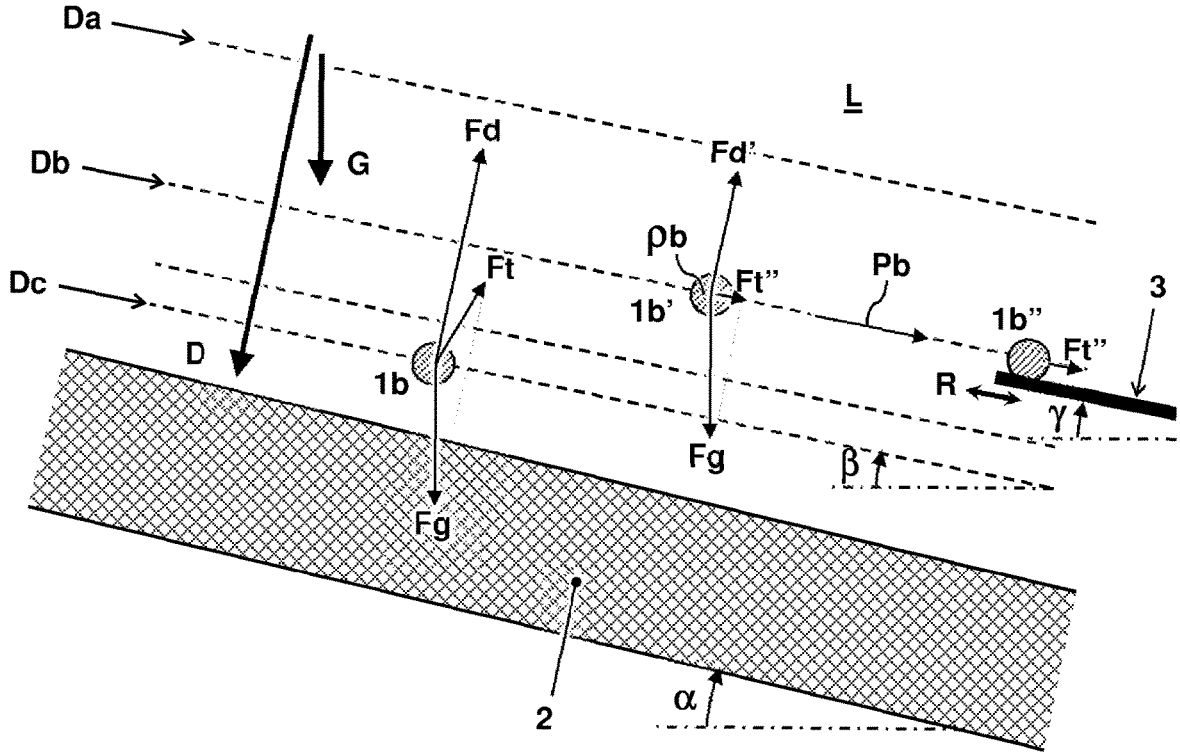
FIG. 2B schematically illustrates a cross-section side view of different density layers in the magnetic liquid and corresponding forces on the products.

FIG. 2B schematically illustrates a cross-section side view of different density layers in the magnetic liquid and corresponding forces on the products. As an example, the product 1*b*,1*b*' and 1*b*" illustrate different stages of the product with density ρb along its path.

In equilibrium, the respective products 1*b*' travel along respective equidensity paths through the magnetic liquid L, e.g. wherein a density of the respective products ρb equals a density of the magnetic liquid Db. Preferably, the plate shape 3 extends in a direction parallel to the product path Pb.

In this case, the plate shape 3 extends in a direction parallel to an equidensity line Db of the magnetic liquid L.

In one embodiment, the magnet 2 is tilted at an angle α with respect to a horizontal plane to create tilted equidensity lines Db in the magnetic liquid L that are also an angle β with respect to the horizontal plane. In one embodiment, the angle α of the magnet plane with respect to the horizontal plane is more than one degree, preferably more than five degrees. Preferably the angle α is less than twenty degrees, preferably less than fifteen degrees, preferably less than ten degrees, e.g. between eight and nine degrees. When the tilt is too steep, products may travel too fast which may affect the available time for equilibration and/or the influence of lift forces, especially when the products comprise asymmetric scrap particles. When the tilt is not steep enough, the process throughput may be too low. It is found that when the tilt is kept within these preferred ranges, the influence of lift forces, can be well controlled at reasonable process speed.

As illustrated, respective products 1*b* travel through the magnetic liquid L along tilted equidensity lines Db (at angle β), under the influence of a gravity force Fg on the respective products 1*b*. The gravity force Fg on the respective products 1*b* is at an angle with respect to a buoyancy force Fd, caused by the density gradient D of the magnetic liquid L, resulting in a net driving force Ft on the respective products 1*b* along the respective product paths Pb. It is noted there may be a deviation between the angle α of the magnet and the angle β of the density lines Da,Db,Dc e.g. caused by the effects of gravity G on the liquid density.

In one embodiment, the system comprises one or more reciprocating plates 3 that are inclined at an angle γ with respect to a horizontal plane. Advantageously, products 1*b*" that lie on the inclined reciprocating plate may be moved in a downward direction under the influence of gravity G while static friction forces are lowered. This is particularly advantageous for an embodiment with a reciprocating inclined splitter plate, wherein the particles are moved along their intended path while they leave the influence of the magnetic field (which may cause the particles to sink).

The angle γ of the plate shape 3 as well as the direction of the reciprocating motion R are preferably adjustable, e.g. to empirically accommodate the direction in accordance with the process flow. Also a height of one or more plate shapes may be adjustable to accommodate different materials and densities.

Figure 3A:
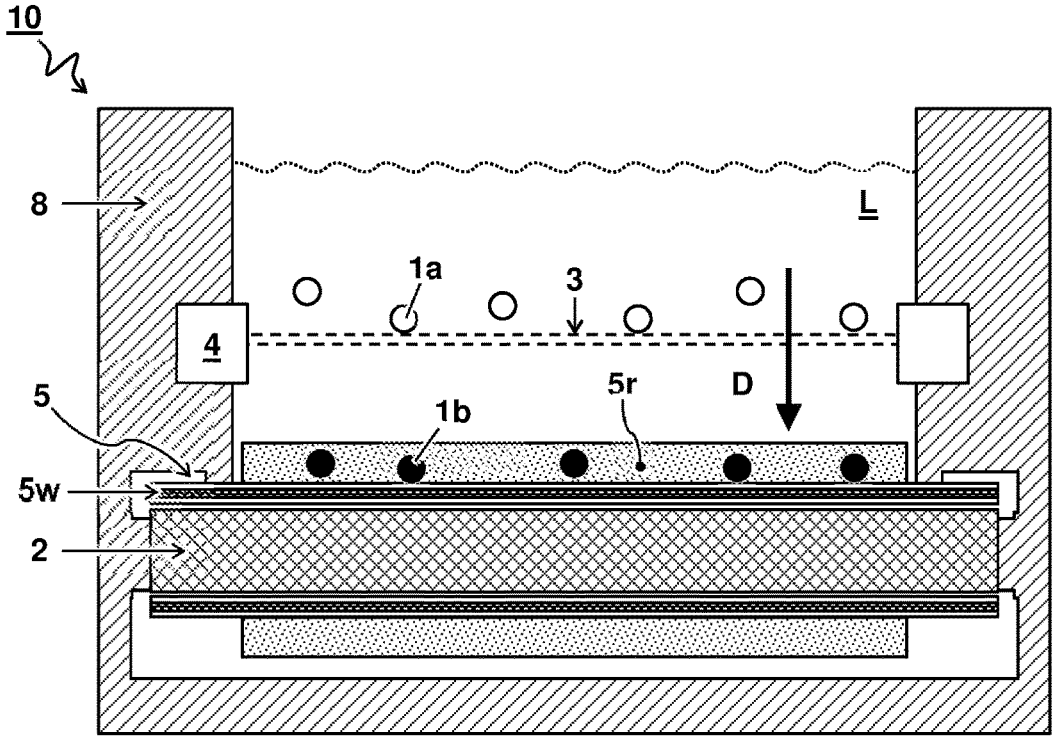
FIG. 3A schematically illustrates a cross-section front view of an embodiment with a conveyor belt immersed in magnetic liquid.
Figure 3B:
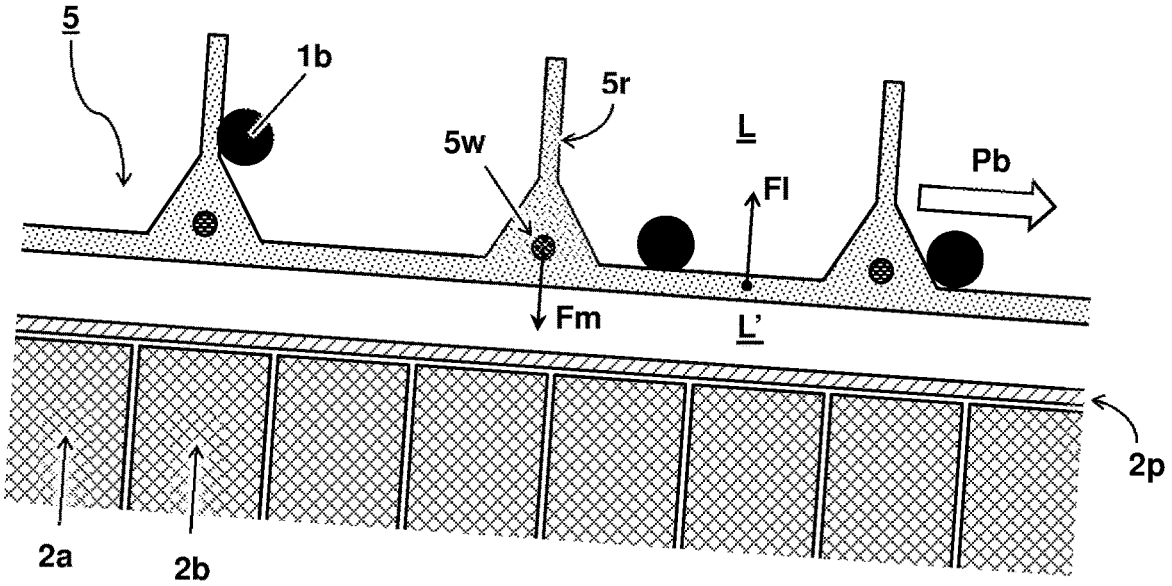
FIG. 3B schematically illustrates a cross-section side view detail of an embodiment with an immersed conveyor belt.

FIG. 3A schematically illustrates a cross-section front view of an embodiment with a conveyor belt immersed in magnetic liquid. FIG. 3B schematically illustrates a cross-section side view detail of an embodiment with an immersed conveyor belt.

In one embodiment, the conveyor belt 5 is immersed in the magnetic liquid L. In another or further embodiment, the conveyor belt 5 comprises a magnetisable material 5*w* that is attracted to the magnet 2 for at least partially compensating a buoyancy force Fl on the conveyor belt 5. For example, the magnetisable material is provided by wires 5*w* extending through the conveyor belt 5. Preferably, the wires 5*w* are cylindrical and/or run along a length transverse to a transport direction of the conveyor belt 5. In the shown embodiment, conveyor belt 5 comprises riffles 5*r* for pushing products 1*b* on the conveyor belt 5 along a respective product path P.

In one embodiment, the magnet is formed by a plurality of magnetic and/or magnetisable pole pieces 2*a*,2*b*. For example, the pole pieces 2*a*,2*b* form a Halbach array configured to amplify a magnetic field on one side of the magnet 2 where the products 1*a*,1*b* travel through the magnetic liquid L. In one embodiment, magnetic liquid L' is separated from the magnets or magnets by a cover plate 2*p*. The cover plate may also function to keep the configuration of magnets in place, particularly if a frustrated configuration is used where north-south poles of adjacent magnets have different directions.

Figure 4A:
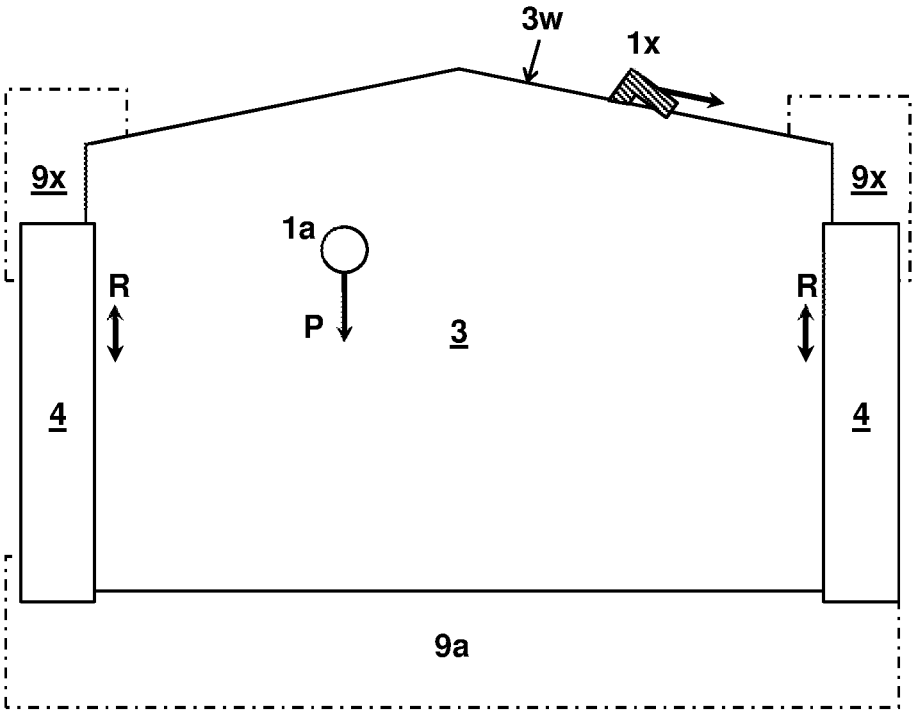
FIG. 4A schematically illustrates a top view of an embodiment of a reciprocating V-shaped plate.
Figure 4B:
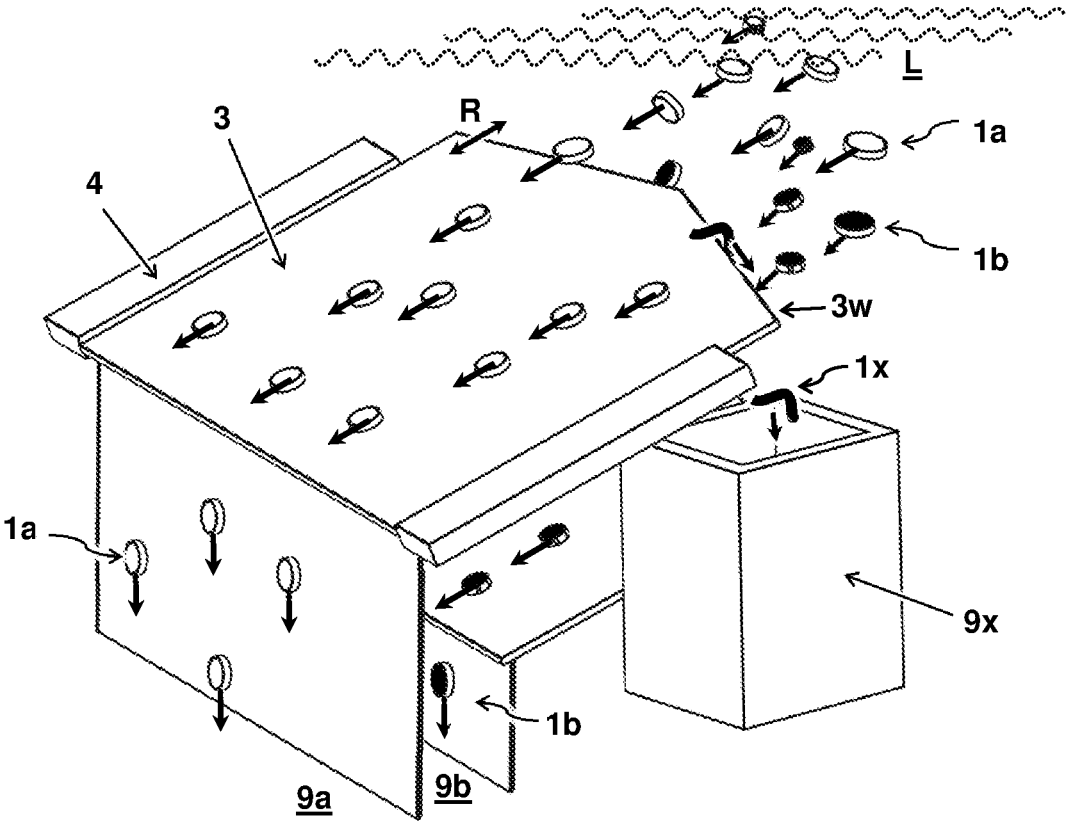
FIG. 4B schematically illustrates a perspective view of the embodiment with the reciprocating V-shaped plate.

In one embodiment, the magnetic liquid height at the splitter point is more than the 30-40 mm of liquid that can be sustained on the belt by the field of the magnet. For six to eight products, typically at least 120-200 mm of liquid height is needed at the position of the splitter. In that case the liquid may need to be contained in a vessel or container, and consequently, the liquid can move freely between the conveyor and the magnet. The force driving the liquid between the belt and the magnet is so strong that the belt is lifted for any reasonable tension on the belt. This problem may be alleviated by inserting for example cylindrical magnetic or magnetisable steel wires preferably at the base of the riffles 5*r*, as shown in the figure. Typical diameters of these steel wires are 3-4 mm, e.g. for one wire every ten centimetres of the belt length. The wire diameters can be less, e.g. when using more wires per belt length or the wire diameters can be more for less wires per belt length. The circular cross-section is ideal for generating a constant force towards the magnet surface, regardless of the position of the wire with respect to the magnet poles FIG. 4A schematically illustrates a top view of an embodiment of a reciprocating plate. FIG. 4B schematically illustrates a perspective view of the embodiment.

In one embodiment, the plate shape 3 is held by a linear guidance configured to direct the reciprocating motion along a single path. For example, the reciprocating motion R is a linear motion, i.e. back and forth along a single direction. In one embodiment, the reciprocating motion R is in a direction along the product path P. Alternatively, the reciprocating motion can also be transverse to the product path P, e.g. still in plane of the plate shape 3.

In one embodiment, the plate shape 3 comprises a wedge shape facing the incoming products 1*a*,1*b*. Accordingly, the wedge shape is configured to direct products 1*x* outward. For example, the plate shape 3 comprises a triangular shape or V-shape, as shown. In another or further embodiment, the system 10 comprises a side exit channel 9*x* to receive the products 1*x* directed outwards by the plate shape. As illustrated in FIG. 4B, the side exit channel 1*x* may be disposed below a side of the plate shape 3. For example, when the effects or the magnetic field diminish at the side, the density of the liquid may be relatively low and the products 1*x* may drop into the channel 9*x*. This may particularly be useful to get rid of long filaments 1*x* that would otherwise get stuck on the edge of the plates shape It is generally noted that MDS systems based on inclined magnets may conventionally lead to blocking because the driving force for the particles (parallel to surface component of gravity) is typically very low. If this force is increased by inclining the magnet at an angle of more than 15%, it is found that the higher differential speed between asymmetrical scrap particles and the magnetic fluid may generate lift forces which push the particle away from its equilibrium height according to its density. These particles may then end up into the wrong product stream. One problem is that a gentle force on the particle may not be enough to push particles that move at about the same height as a splitter over or under the splitter, and to move a particle that has just moved over the edge of a splitter against the friction force between the splitter and the particle. Both of these problems are alleviated by reciprocating the splitter in a direction which is preferably parallel to the splitter surface. This will induce small particles to jump over or below the splitter edge and avoids static frictional forces between particle and splitter surface. Scrap particles floating near a splitter position may also fold around the edge of a splitter. For this, the splitter is preferably provided with a wedge shaped ending facing the product stream. Together, these measures may alleviate the problems of blocking. The splitter preferably propels a minimum of fluid while reciprocating. Therefore it is preferably not connected to vertical walls separating the product compartments.

For the purpose of clarity and a concise description, features are described herein as part of the same or separate embodiments, however, it will be appreciated that the scope of the invention may include embodiments having combinations of all or some of the features described. For example, while embodiments were shown for various parts of magnetic density separators, also alternative ways may be envisaged by those skilled in the art having the benefit of the present disclosure for achieving a similar function and result. E.g. electrical, magnetic, and mechanical parts may be combined or split up into one or more alternative components. The various elements of the embodiments as discussed and shown offer certain advantages, such as improved process continuity and/or separation efficiency. Of course, it is to be appreciated that any one of the above embodiments or processes may be combined with one or more other embodiments or processes to provide even further improvements in finding and matching designs and advantages. It is appreciated that this disclosure offers particular advantages to improve splitter plates at the exit of a system for magnetic density separation, but may also be applied in other positions. The present systems may find application for example in the separation of a product waste stream but can also be used to separate other streams, e.g. raw products such as mining products.

While the present systems and methods have been described in particular detail with reference to specific exemplary embodiments thereof, it should also be appreciated that numerous modifications and alternative embodiments may be devised by those having ordinary skill in the art without departing from the scope of the present disclosure. For example, embodiments wherein devices or systems are disclosed to be arranged and/or constructed for performing a specified method or function inherently disclose the method or function as such and/or in combination with other disclosed embodiments of methods or systems. Furthermore, embodiments of methods are considered to inherently disclose their implementation in respective hardware, where possible, in combination with other disclosed embodiments of methods or systems.

Finally, the above-discussion is intended to be merely illustrative of the present systems and/or methods and should not be construed as limiting the appended claims to any particular embodiment or group of embodiments. The specification and drawings are accordingly to be regarded in an illustrative manner and are not intended to limit the scope of the appended claims. In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s) or implemented structure or function; any of the disclosed devices or portions thereof may be combined together or separated into further portions unless specifically stated otherwise. The mere fact that certain measures are recited in mutually different claims does not indicate that a combination of these measures cannot be used to advantage. In particular, all working combinations of the claims are considered inherently disclosed.

The invention claimed is:

1. A system for magnetic density separation of products), the system comprising:

a magnet configured to amplify a density gradient in a magnetic liquid for separating the products in the magnetic liquid according to their different density;

a splitter plate formed by a flat two-dimensional structure disposed along a product path in the magnetic liquid, wherein a surface of the splitter plate is configured to form a barrier between respective product streams along which respective products travel through the magnetic liquid according to their density; and a driving mechanism configured to drive the splitter plate with a reciprocating motion directed along an in-plane direction of the splitter plate.

2. The system according to claim 1, comprising two or more reciprocating splitter plates each configured to separated products in respective product streams.

3. The system according to claim 1, wherein the reciprocating splitter plates is inclined at an angle with respect to a horizontal plane.

4. The system according to claim 1, wherein the splitter plate has a thickness of less than five millimeters for displacing a minimum of magnetic liquid while moving with the reciprocating motion along the in-plane direction.

5. The system according to claim 1, wherein the splitter plate extends in a direction parallel to an equidensity line of the magnetic liquid.

6. The system according to claim 1, wherein the splitter plate is held by a linear guidance structure configured to direct the reciprocating motion along a single path.

7. The system according to claim 1, wherein the driving mechanism is configured to drive the splitter plate with a reciprocating motion having an amplitude between one and five millimetres.

8. The system according to claim 1, wherein the driving mechanism is configured to drive the splitter plate with a reciprocating motion having a frequency between five and thirty Hertz.

9. The system according to claim 5, wherein the magnet is tilted at an angle with respect to a horizontal plane to create tilted equidensity lines in the magnetic liquid that are also an angle with respect to the horizontal plane such that respective products travel through the magnetic liquid along tilted equidensity lines under the influence of a gravity force on the respective products.

10. The system according to claim 1, comprising a conveyor belt configured to transport products as they come into contact with the conveyor belt, wherein the conveyor belt is immersed in the magnetic liquid, wherein the conveyor belt comprises a magnetisable material that is attracted to the magnet for at least partially compensating a buoyancy force on the conveyor belt.

11. The system according to claim 1, wherein the splitter plate comprises a wedge shape facing the incoming products, wherein the wedge shape is configured to direct products outward.

12. The system according to claim 11, comprising a side exit channel to receive the products directed outwards by the splitter plate.

13. The system according to claim 12, wherein the side exit channel is disposed below a side of the splitter plate.

14. A system for magnetic density separation of products, the system comprising a magnet configured to amplify a density gradient in a magnetic liquid for separating the products in the magnetic liquid according to their different density, wherein the magnet is tilted at an angle with respect to a horizontal plane to create tilted equidensity lines in the magnetic liquid that are also an angle with respect to the horizontal plane such that respective products travel through the magnetic liquid along tilted equidensity lines under the influence of a gravity force on the respective products;

a plate structure disposed along a product path where respective products travel through the magnetic liquid, wherein the plate structure extends in a direction parallel to an equidensity line of the magnetic liquid; and a driving mechanism configured to drive the plate structure with a reciprocating motion.

15. The system according to claim 14, wherein the splitter plate comprises a wedge shape facing the incoming products, wherein the wedge shape is configured to direct products outward.

16. A system for magnetic density separation of products, the system comprising a magnet configured to amplify a density gradient in a magnetic liquid for separating the products in the magnetic liquid according to their different density;

a splitter plate formed by a flat two-dimensional structure disposed along a product path in the magnetic liquid, wherein a surface of the splitter plate is configured to form a barrier between respective product streams along which respective products travel through the magnetic liquid according to their density; and a conveyor belt configured to transport products as they come into contact with the conveyor belt, wherein the conveyor belt is immersed in the magnetic liquid, wherein the conveyor belt comprises a magnetisable material that is attracted to the magnet for at least partially compensating a buoyancy force on the conveyor belt.

17. The system according to claim 16, wherein the splitter plate comprises a wedge shape facing the incoming products, wherein the wedge shape is configured to direct products outward.

18. The system according to claim 17, comprising a side exit channel to receive the products directed outwards by the plate shape.

19. The system according to claim 16, wherein the splitter plate extends in a direction parallel to an equidensity line of the magnetic liquid.

20. The system according to claim 19, wherein the magnet is tilted at an angle with respect to a horizontal plane to create tilted equidensity lines in the magnetic liquid that are also an angle with respect to the horizontal plane such that respective products travel through the magnetic liquid along tilted equidensity lines under the influence of a gravity force on the respective products.

* * * * *